United States Patent [19]

Hanscom

[11] 4,106,264

[45] Aug. 15, 1978

[54] APPARATUS FOR COMPRESSING AND HOLDING A HANKED PACKAGE OF FLEXIBLE MATERIAL DURING FASTENING

[75] Inventor: Harris F. Hanscom, Barrington, R.I.

[73] Assignee: H. F. Hanscom & Company, Inc., Providence, R.I.

[21] Appl. No.: 735,028

[22] Filed: Oct. 22, 1976

[51] Int. Cl.[2] ..... B65B 13/20

[52] U.S. Cl. ..... 53/124 D; 53/24; 100/214; 242/53

[58] Field of Search ..... 53/3, 24, 124 D, 198 R; 242/53; 100/3, 5, 214

[56] References Cited

U.S. PATENT DOCUMENTS

| | | | |
|---|---|---|---|
| 2,331,004 | 10/1943 | Standish | 242/53 X |
| 2,504,993 | 4/1950 | Lobasso | 53/124 D |
| 2,654,980 | 10/1953 | Dexter | 242/53 X |
| 3,416,287 | 12/1968 | Hawkins et al. | 53/3 |
| 3,480,220 | 11/1969 | Hanscom | 242/53 |
| 3,824,759 | 7/1974 | Finn et al. | 53/24 |
| 3,506,701 | 9/1975 | McIntyre | 53/3 |

*Primary Examiner*—Frank T. Yost
*Attorney, Agent, or Firm*—Barlow & Barlow

[57] ABSTRACT

A method and apparatus for compressing and holding a hanked package of flexible material during fastening is disclosed in which a package which has been transferred from a previous winding station, is resiliently compressed by arms that are urged toward a support for the hanked package to compress the package, separate means fastening the hanked package while compressed, and after fastening the arms release the package.

9 Claims, 5 Drawing Figures

APPARATUS FOR COMPRESSING AND HOLDING A HANKED PACKAGE OF FLEXIBLE MATERIAL DURING FASTENING

BACKGROUND OF THE INVENTION

Two basic approaches have been used in the past to obtain high production rates in the commercial hanking and packaging of precut lengths of insulated wire and other relatively flexible materials. The first involves a multi-station turret type of machine which is loaded and performs a winding operation at one station (or between the first and second station), a fastening operation at a second station and ejection of the finished package at a third station. In this technique, several winding heads are mounted on a rotatable turret. The turret indexes and stops at each station, dwelling long enough to allow an already wound and fastened package to be ejected at the third station while another wound cord is fastened at the second station and a fresh cord is being loaded and wound at the first station. It is apparent that this technique allows various operations to be performed simultaneously on different cords at different stations, thereby yielding maximum production rates.

The second approach to obtain optimum production rates with a simpler and less expensive machine which is quickly adjustable to accommodate a very wide range of package configurations is detailed in the Hanscom U.S. Pat. Nos. 2,770,183, 3,480,219 and 3,480,220. In this technique, a single winding station and a single fastening station are affixed to a basic machine frame. An automatic hand is used to transfer the package from the winding to the fastening station which hand simply picks up the wound bundle, transfers and deposits it at the fastening station, and returns for the next transfer cycle. This approach obviously allows simultaneous loading and winding, transfer, fastening, and ejection operations and is therefore very efficient. The simplicity of the machine makes it relatively inexpensive and widely adjustable.

SUMMARY OF THE INVENTION

A packaging mechanism having arms or the like which press the package down against a receiving surface or support upon which the package rests while the fastening of the package in hank form occurs. In a specific embodiment, hold down arms are operated by a bell crank lever and one of the legs of this bell crank lever is pressed down by a vertically reciprocating part of the machine with which it is to be attached and in turn resiliently moves the hold down means into package pressing position. A hook engages the bell crank lever momentarily while the tieing occurs and then a cam lifts the hook which holds the bell crank lever in down position to release it and permit a resilient means to move the bell crank lever to initial position and permits the hold down means to move upwardly to release position after which the cycle is repeated.

DESCRIPTION OF THE PREFERRED EMBODIMENT

Figure 3:
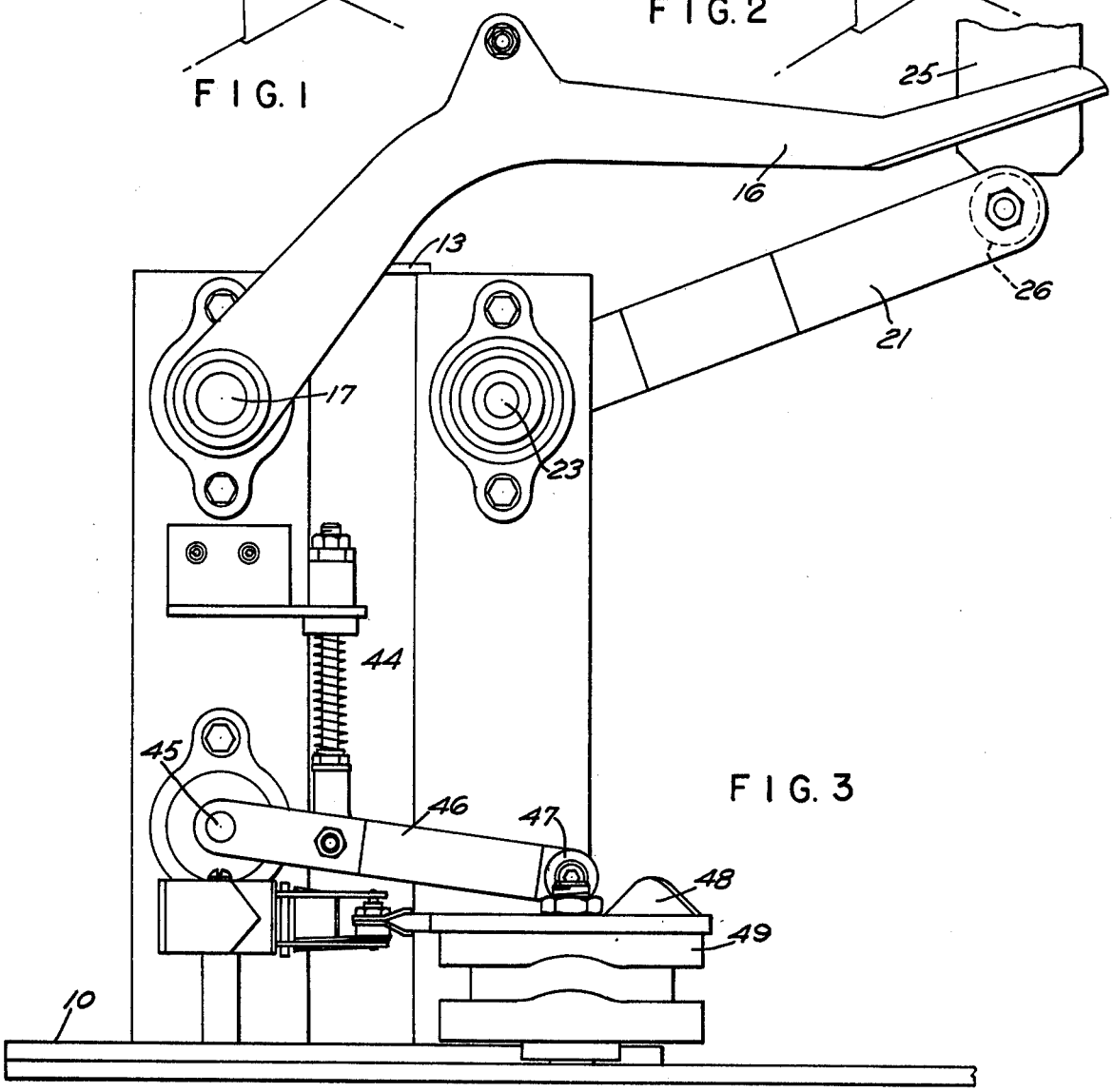
FIG. 3 is a side elevation of the hold down mechanism in raised position.
Figure 4:
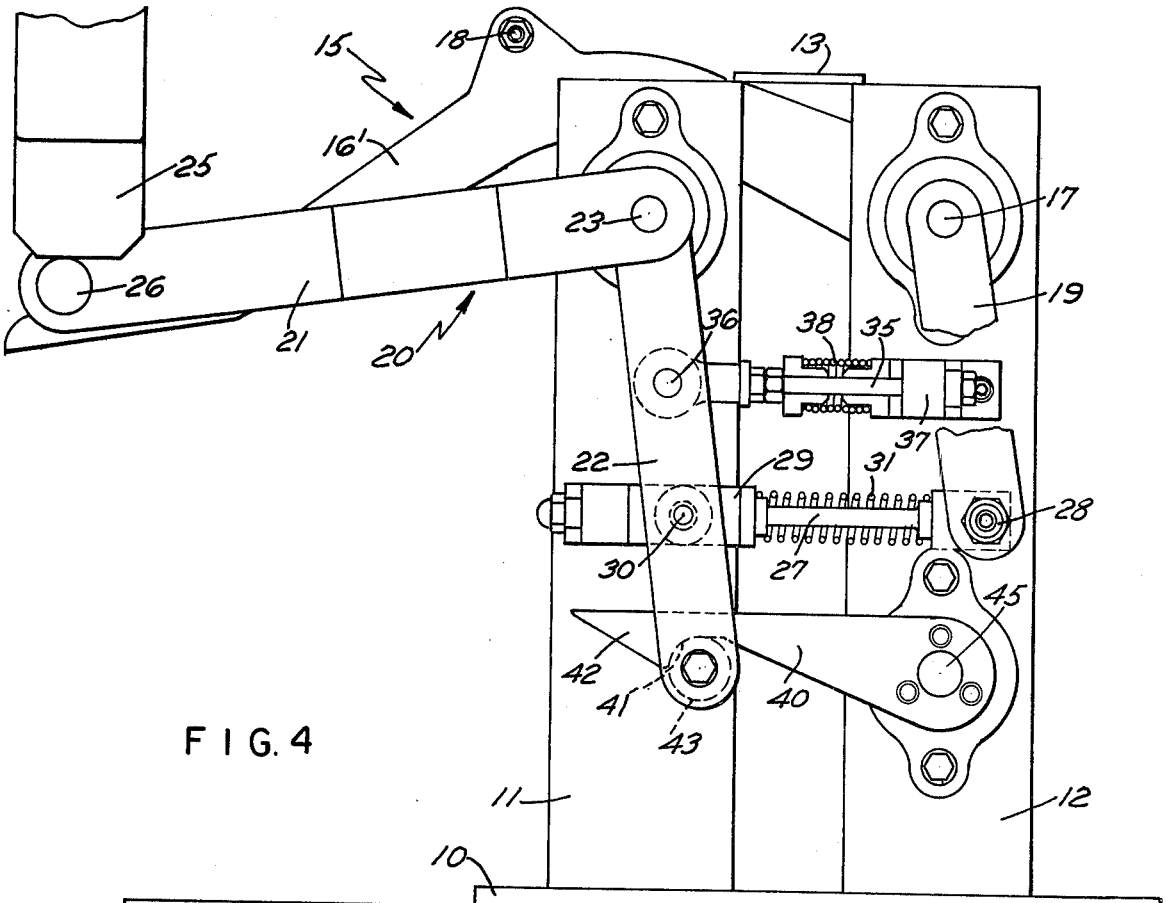
FIG. 4 is a side elevation looking at the opposite side of the machine from the view of FIG. 1.
Figure 5:
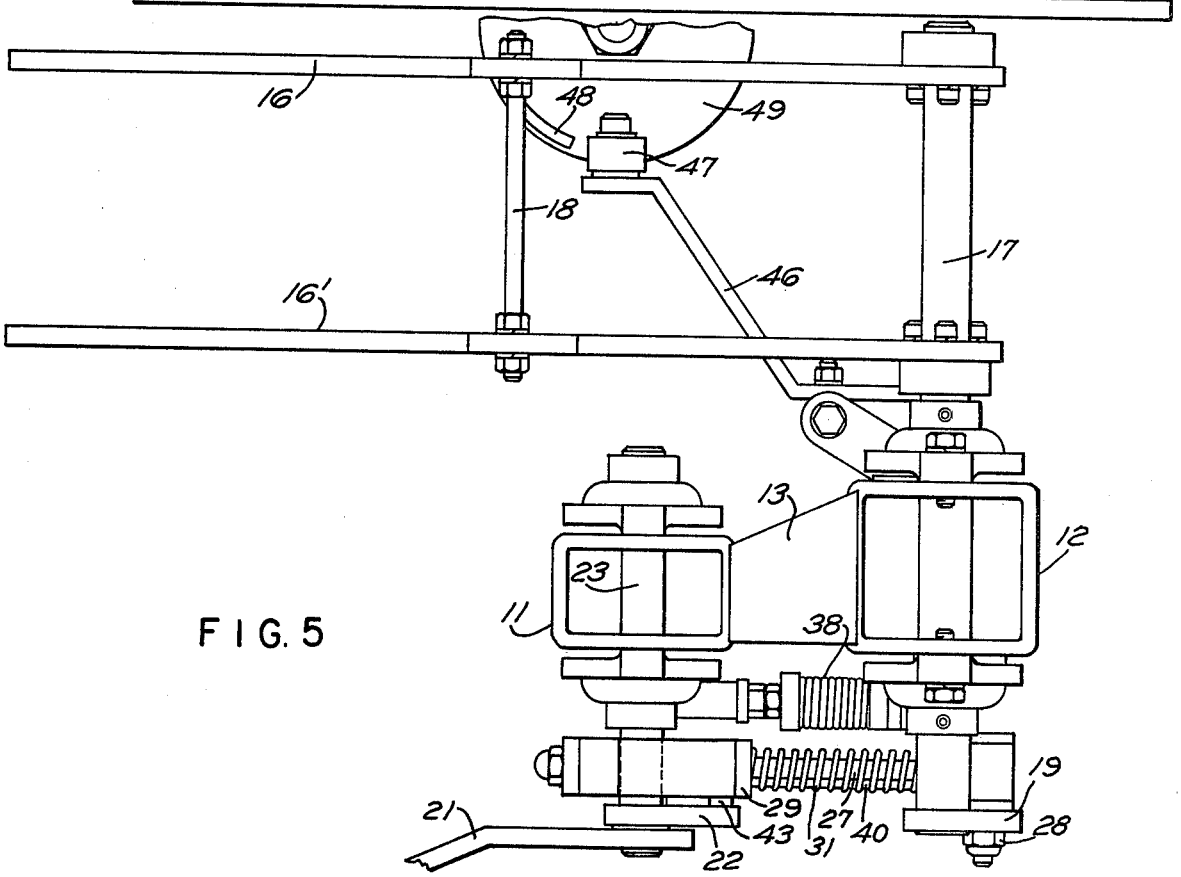
FIG. 5 is a top plan view.

Referring to FIGS. 3 and 4, 10 designates the base of the mechanism from which there arises an upright stand which is shown in two parts 11 and 12 welded to the base 10 and joined together by a plate 13 at their upper ends. The package engaging means is designated generally 15 and comprises a pair of arms 16, 16′ spaced from each other a suitable distance to engage the package at spaced locations. The arms 16, 16′ are mounted upon a rotatable shaft 17 which extends through and is journaled in upright stand 12. The arms 16, 16′ are free to rock to one side of the stand 12. A cross brace 18, spaced from the shaft 17, supports the arms in this spaced relation as shown perhaps best in the top plan view of FIG. 5. The hold down arms 16, 16′ which extend at one side of the support 12 are rotationally connected to a second arm 19 (FIG. 4) which extends downwardly and at an angle to the arms 16, 16′ for a purpose to be presently described.

A bell crank lever designated generally 20 (see FIG. 4) is pivoted on a shaft 23 which extends through the upright stand portion 11 and comprising legs 21 and 22. Leg 21 extends into a location beneath a vertically reciprocating part 25 of the machine (see FIGS. 2 and 4) with which this mechanism is to operate, so that this part 25 may engage a roller 26 on the free end of the leg 21 and swing the bell crank lever 20 about its pivot 23. The bell crank lever arm 22 is resiliently attached to the second arm 19 by means of a rod 27 attached as at 28 to the free end of the second arm 19 and which is free to slide through a tube 29 pivotally attached as at 30 to the leg 22, a coil spring 31 being inserted between the tube 29 and the base of rod 27 so that these two parts are resiliently connected and will allow some compression through the action of spring 31 as the bundle or package is engaged by spaced arms 16, 16′. The leg 22 is also connected by rod 35 pivotally attached as at 36 to the leg 22 and which will slide through a tube 37 on the upright stand portion 12. A spring 38 will permit the rod 35 to slide through the tube 37 against the action of the spring 38 and will force the leg 22 and the bell crank lever clockwise to return to the up position shown in FIG. 4 if there is no pressure upon the roller 26 so that it may rise.

When the bell crank lever is depressed by some vertically moving part such as 25, it will be rocked clockwise (FIG. 3) to bring the arms 16, 16′ down against the package and a latch 40 having a hook portion 41 and a beveled end 42 will slide over a roller 43 on the end of the leg 22 and hold the bell crank lever and hold down arms within depressed position, while the tieing action on the package engaged is performed. A spring 44 (FIG. 3) holds this latch in down position but as the bell crank roller 43 engages the bevel 42 of the latch, the latch will lift and roller 43 will slide under and be hooked by the portion 41. Latch 40 is mounted on a shaft 45 extending from one side of upright 12 and on the other side of the upright stand 12 there is an arm 46 which is fixed to the shaft 45 and extends from the shaft substantially parallel with the latch 40. Arm 46 carries a roller 47 (FIGS. 3 and 5) at its free end or at its end distant from its pivoting shaft and a cam 48 on the horizontally rotating disc 49 which has one revolution for each package engaged (and might be tied to a gear such as gear 46 in FIG. 3 of Hanscom U.S. Pat. No. 2,770,183) will swing the latch upwardly to release the latch once each revolution or once each completion of the tieing of the package, and permit spring 38 to raise the bell crank lever by action on the leg 22 to raised position and at the same time raise the hold down arms 16, 16' through the resilient connection 27 to 31 to the raised position for the discharge of the completed package from the machine and the insertion of a newly wound package into the machine for tieing.

Figure 1:
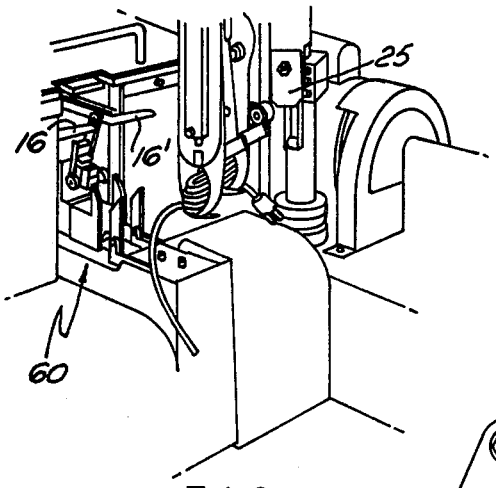
FIG. 1 is a fragmental perspective view of the machine showing the package being transferred to binding position.
Figure 2:
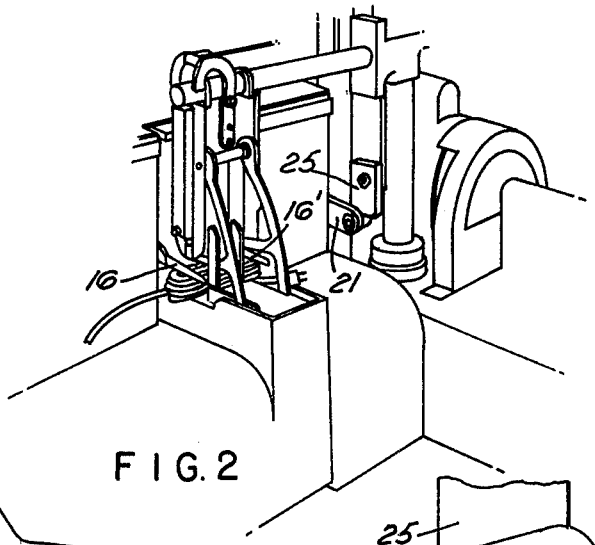
FIG. 2 is a similar view with mechanism holding the package to be bound.

FIGS. 1 and 2 illustrate the manner in which the hold down arms can operate in conjunction with a mechanism which is available for hanking electric cords and the like. For example, if one tries to hank an S cord, that is an electrical cord which has two or three conductors and an outer jacket consisting of a rather stiff neoprene sleeve, the entire cord is one which is stiff and does not lend itself well to being wrapped with an automatic tieing machine. For example, as seen in FIG. 1, the transfer arm is bringing a hanked electrical cord from a previous winding operation by way of gripping fingers over into a tieing station which is generally indicated by the numeral 60. In FIG. 2 the electrical cord has been dropped in between guides at the tieing station and the arms 16, 16' have lowered themselves to engage the cord set, compress it and hold it down against a support. As previously explained, the arms will hold the cord set or other bundle against the platform with automatic adjustment for the size of the bundle, inasmuch as the spring 31 will take up the differential and maintain the arms 16, 16' in downward urgence with sufficient compression so that now, the arms that are utilized to wrap tie around the cord set can come into operation and suitably place a tie around the wire bundle as more fully disclosed in Hanscom U.S. Pat. No. 2,770,183 above referred to (see FIGS. 8 and 13). After fastening the cord set, or the like, the arms compressing the cord set will release the package and an ejector at the wrapping station 60 will push the packaged cord set out of position into a receptacle (not shown).

I claim:

1. In a packaging mechanism, means for compressing a package comprising an upright stand, a pair of package engaging means pivoted on said stand with arms on one side of the pivot to engage the package and a second arm extending from the other side of the pivot, a bell crank lever pivoted on said stand and at a location spaced from the pivot of said package engaging means and having legs extending from its pivot, resilient means extending from said second arm to one of the legs, the other leg of the bell crank lever being engageable to swing it and move said second arm and the package engaging means into engagement with the package, hook means to hold said lever in package engaging position, means to wrap the package while engaged, means actuatable to release said hook means from engaging position and means to return said bell crank lever to preswung position.

2. In a packaging mechanism as in claim 1 wherein said hook means is resiliently pressed into holding position.

3. In a packaging mechanism as in claim 1 wherein said means to return said bell crank lever also returns the package engaging means to starting position.

4. In a packaging mechanism as in claim 1 wherein said means to return said bell crank lever also returns the package engaging means to starting position through the resilient connection of said second arm and one of the legs.

5. A mechanism for compressing a package comprising an upright stand, a pair of package engaging means pivoted on said stand with arms on one side of the pivot to engage the package and a second arm extending from the other side of the pivot, a bell crank lever pivoted on said stand and at a location spaced from the pivot of said package engaging means and having legs extending from its pivot, resilient means extending from said second arm to one of the legs, the other leg of the bell crank lever being engageable to swing it and move said second arm and the package engaging means into engagement with the package, hook means to hold said lever in package engaging position, means actuatable to release said hook means from engaging position and means to return said bell crank lever to preswung position.

6. A mechanism as in claim 5 wherein said hook means is resiliently pressed into holding position.

7. A mechanism as in claim 5 wherein said means to return said bell crank lever also returns the package engaging means to starting position.

8. A mechanism as in claim 5 wherein said means to return said bell crank lever also returns the package engaging means to starting position through the resilient connection of said second arm and one of the legs.

9. In a packaging mechanism means for accepting a hanked package of flexible material from a transfer hand, a vertically reciprocating member operable in timed relation to said transfer hand, a pair of spaced arms, means to pivot said arms to swing into engagement with the hanked package at spaced locations on the package, means including a resilient connection to said arms and operable by said reciprocating member and to swing said arms into engagement with said hanked package and compress the same through said resilient connection at the spaced points of engagement and means to wrap the hanked package.

* * * * *